US010959555B2

(12) United States Patent
Lee

(10) Patent No.: US 10,959,555 B2
(45) Date of Patent: Mar. 30, 2021

(54) TABLEWARE HANDLE AND TABLEWARE THEREOF

(71) Applicant: Kolor Magnetic (Shenzhen) Co., Ltd., Guangdong (CN)

(72) Inventor: Chi Wai Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 73 days.

(21) Appl. No.: 16/239,621

(22) Filed: Jan. 4, 2019

(65) Prior Publication Data

US 2019/0365127 A1 Dec. 5, 2019

(30) Foreign Application Priority Data

Jun. 5, 2018 (CN) ..... 201810568038.7

(51) Int. Cl.
*A47G 21/00* (2006.01)
*A47G 21/02* (2006.01)

(52) U.S. Cl.
CPC ..... *A47G 21/023* (2013.01)

(58) Field of Classification Search
CPC ..... A47G 21/02–06; A47J 43/28–282; A61J 7/0023
USPC ..... D7/643, 653; 30/142–150, 322–328
See application file for complete search history.

(56) References Cited

U.S. PATENT DOCUMENTS 146,070 A * 12/1873 Hart ..... B26B 3/00 30/328
D20,545 S * 3/1891 Galt ..... D7/653
D42,146 S * 2/1912 Osborne ..... D7/653
1,238,149 A * 8/1917 Kean ..... A47J 43/288 30/345
D74,863 S * 4/1928 Cornell ..... D7/653
2,216,005 A * 9/1940 Goldstein ..... A47G 21/02 30/150
D138,562 S * 8/1944 Warren ..... D7/653
D180,073 S * 4/1957 Doerfler ..... D7/653
D190,250 S * 5/1961 Latham ..... D7/653
4,524,512 A * 6/1985 Formo ..... A47G 21/06 30/147
D299,899 S * 2/1989 Liebmann ..... D7/653
D307,095 S * 4/1990 Juergens ..... D7/653
D362,160 S * 9/1995 Brabeck ..... D7/643
D374,800 S * 10/1996 Liistro ..... D7/653
D387,956 S * 12/1997 Gagnon ..... D7/653
(Continued)

FOREIGN PATENT DOCUMENTS

GB 2574491 A * 12/2019 ..... A47G 21/023
WO WO-2019232984 A1 * 12/2019 ..... A47G 21/023

*Primary Examiner* — Jason Danil Prone

(57) ABSTRACT

A tableware handle is provided. The tableware handle includes a handle body with a central axis, wherein the handle body has a cross section of "W" shape which is axisymmetrically distributed along the central axis. A tableware is provided. The tableware includes the tableware handle discussed above and a food taking portion fixedly connected with each other. The tableware handle and tableware thereof having a lightweight and good strength, are especially not easy to be broken and can be stacked stably. Moreover, there are small stacking clearance between the tableware handles, saving packaging, storage and transportation space. In additional, the tableware handle and tableware thereof are safe to use, light, comfortable and environmental protected.

2 Claims, 9 Drawing Sheets

(56) References Cited

U.S. PATENT DOCUMENTS

D388,664 S * 1/1998 Gagnon ..... D7/643
D391,454 S * 3/1998 Iacovelli ..... D7/653
5,904,250 A * 5/1999 De Schutter ..... A47G 21/06 30/142
D411,938 S * 7/1999 Morrison ..... D7/401.2
D415,928 S * 11/1999 Kaposi ..... D7/401.2
6,134,790 A * 10/2000 Watson ..... A47G 21/02 30/326
D449,765 S * 10/2001 Toffolon ..... D7/401.2
6,408,524 B1 * 6/2002 Lai ..... A47G 21/02 30/324
6,457,636 B1 * 10/2002 Van de Ven ..... B65D 5/324 220/DIG. 25
6,701,625 B1 * 3/2004 Thomason ..... A47G 21/04 30/324
7,013,568 B2 * 3/2006 Schmidt ..... A47G 21/06 30/147
D530,987 S * 10/2006 Lee ..... D7/653
D536,222 S * 2/2007 Heiberg ..... D7/645
D552,432 S * 10/2007 Shane-Schuldt ..... D7/653
D575,594 S * 8/2008 Richmond ..... D7/653
D625,551 S * 10/2010 Holcomb ..... D7/401.2
D634,975 S * 3/2011 He ..... D7/653
8,079,390 B2 * 12/2011 Bigsby ..... A47G 21/02 144/359
D663,581 S * 7/2012 Oakes ..... D7/401.2
8,272,132 B2 * 9/2012 Bolgert ..... A47J 43/28 30/324
D675,869 S * 2/2013 Gallop ..... D7/401.2
D684,434 S * 6/2013 Harris ..... D7/401.2
D705,006 S * 5/2014 Dicocco ..... D7/401.2
D706,586 S * 6/2014 Kestenbaum ..... D7/688
8,776,379 B2 * 7/2014 Walters ..... A47G 21/06 30/142
8,839,522 B2 * 9/2014 Walters ..... A47G 21/06 30/142
D717,111 S * 11/2014 Wang ..... D7/653
D717,112 S * 11/2014 Wang ..... D7/653
D720,586 S * 1/2015 Grinalds ..... D7/643
D756,171 S * 5/2016 Mou ..... D7/653
D756,172 S * 5/2016 Mou ..... D7/653
9,549,626 B2 * 1/2017 Truog ..... A47G 21/06
D778,120 S * 2/2017 Mou ..... D7/653
D796,271 S * 9/2017 McFarland ..... D7/653
9,924,816 B2 * 3/2018 Oakes ..... A47G 21/06
10,081,095 B1 * 9/2018 Lee ..... A47G 21/06
D852,007 S * 6/2019 Oakes ..... D7/653
2005/0155229 A1 * 7/2005 Lee ..... A47G 21/06 30/322
2009/0217532 A1 * 9/2009 Cantu ..... A47J 43/28 30/123
2010/0000096 A1 * 1/2010 Muehlemann ..... A47G 21/02 30/165
2010/0325896 A1 * 12/2010 Hebebrand ..... A47J 43/283 30/150
2013/0152406 A1 * 6/2013 McFarland ..... A47G 21/023 30/322
2013/0247387 A1 * 9/2013 Dietz ..... A47G 21/02 30/345
2017/0340152 A1 * 11/2017 Lee ..... A47G 21/02
2019/0183272 A1 * 6/2019 Malcolm ..... A47G 21/023
2019/0223641 A1 * 7/2019 Oakes ..... A47G 21/023

* cited by examiner

TABLEWARE HANDLE AND TABLEWARE THEREOF

CROSS-REFERENCE TO RELATED APPLICATIONS

The present application claims foreign priority of Chinese Patent Application No. 201810568038.7 filed on Jun. 5, 2018, the contents of which are hereby incorporated by reference.

TECHNICAL FIELD

The present disclosure relates generally to tableware fields, and more particularly, to a tableware handle and tableware thereof.

BACKGROUND

At present, disposable plastic tableware used at home and abroad is developing toward the direction of light, solid, safe, energy-saving and environmental protection. Especially, it needs to have the characteristics of stable stack and adaptability to the clean and sanitary use of self-service tableware.

The disposable plastic tableware on the market now, according to the different handle structures, can be divided into two categories: non-stackable type and stackable type. The advantages of the stackable type over the non-stackable type lie in the convenience of stacking, picking up and packaging in production, especially in reducing the raw materials for production and packaging, saving storage space and transportation costs, to be specific, which generally reducing more than 10% of raw materials and more than 20% of space. Accordingly, the tableware that can be stably stacked can greatly reduce the consumption of raw materials, save storage space and freight. In short, it saves energy and reduces production costs.

No matter the disposable plastic tableware can be stacked or not, the main plastic raw materials are PP (polypropylene) or PS (polystyrene, polystyrene). The main weaknesses of such disposable plastic tableware are insufficient strength. The handle of such disposable plastic tableware is easy to be broken to form sharp knife-like hard objects at the torn section, which may hurt the user or others. Moreover, when the handle of such disposable plastic tableware breaks up, debris may be ejected out at a high speed and hurt others.

Above all, except for the nature of the material, the structure of the product is the key point. The disposable plastic tableware handle has designed different widths, heights, wall thicknesses, shapes and structures at different segments, so such different segments would have different strengths. The segments having poorest strength often become the breaking point of the rapid fracture. Once the breaking point cannot withstand the effect of external force, it will be broken in an instant, generate an impact force for ejecting the debris at a high speed.

In order to avoid being broken easily, in the design of disposable plastic tableware products, it is often necessary to thicken the thickness of the product, that is, to increase the weight, especially to increase the glue thickness of or add reinforcing ribs at the so-called weak points. Although the product strength has been strengthened in such a way, however the strength difference between the different handle segments cannot be avoided. In particularly, when an X-shaped reinforcing rib is added to the handle back, a strong stress will be produced in the reinforcing rib position.

On the contrary, the surrounding points around the reinforcing rib position will be easier to be broken, and the impact force generated at the breaking is stronger and results in greater danger, while the production cost is increased.

SUMMARY

The object of the present application is to provide a tableware handle of lightweight and good strength, which can be used in plastic tableware of fork, spoon, soup ladle, fork spoon, table-knife and so on. Such tableware handle is especially not easy to be broken and can be stacked stably.

In one aspect, a tableware handle is provided, comprising a handle body, a neck portion arranged at a first end of the handle body and a tail portion arranged at a second end of the handle body, the handle body has a "W" shape cross section formed by a convex, two reinforcing grooves and two reinforcing ribs symmetrically arranged on both sides of the convex, the convex has a trigonometric line shape and each of the two reinforcing ribs and two reinforcing grooves are on each side of the convex, the convex is extending along an central axis of the handle body;

wherein a positioning concave structure having a crescent shape is arranged at a front surface of the handle body; wherein the positioning concave structure extends from the second end of the handle body to the tail portion;

the handle body has a front surface and a back surface, in which the front surface containing a culmination of the convex and a culmination of the of the reinforcing grooves and the back surface containing a back surface of the convex which forms a concave groove and a bottom surface of the two reinforcing ribs; wherein the convex and the concave groove both extend along from the tail portion to the neck portion; the two reinforcing grooves and the two reinforcing ribs are all extend along the tail portion to the neck portion.

In another aspect, a tableware is provided, comprising the tableware handle discussed above and a food taking portion fixedly connected with each other.

By the implementation of the tableware handle and tableware thereof, several advantages can be obtained. The tableware handle and tableware thereof having a lightweight and good strength, are especially not easy to be broken and can be stacked stably. Moreover, there are small stacking clearance between the tableware handles, saving packaging, storage and transportation space. In additional, the tableware handle and tableware thereof are safe to use, light, comfortable and environmental protected. Furthermore, the tableware handle and tableware thereof can be stably stacked with each other, so are particularly suitable for being positioned the blanking system of the automatic tableware packaging machine, thus improving the automatic packaging efficiency of tableware.

BRIEF DESCRIPTION OF THE DRAWINGS

The present application is further illustrated combining the embodiments and drawings attached.

Figure 1:
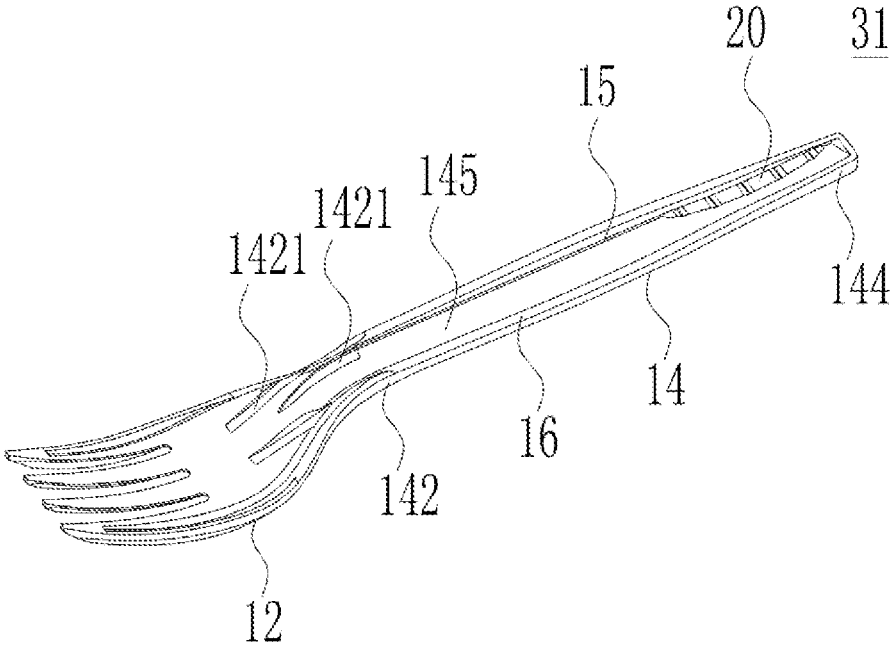
FIG. 1 is a stereogram of a fork from an angle according to a preferable embodiment of the present application.

Reference numbers in the accompanying drawings include:

| | | |
|---|---|---|
| 31 - fork | 12 - food taking portion | 121 - fork tooth reinforcing strip |
| 14 - tableware handle | 141 - handle body | 142 - neck portion |
| 1421 - enhancing block | 144 - tail portion | 145 - front surface |
| 146 - back surface | 15 - convex groove | 16 - reinforcing strip |
| 17 - concave groove | 18 - reinforcing rib | 19 - reinforcing rib groove |
| 20 - reinforcing rib groove | 32 - spoon | 33 - soup ladle |
| 34 - fork spoon | 35 - table-knife | A - central axis |

DETAILED DESCRIPTION OF THE PREFERRED EMBODIMENT

These and other advantage, aspect and novel features of the present invention, as well as details of an illustrated embodiment thereof, will be more fully understand from the following description and drawings. It should be understood that the specific embodiments described herein are intended only to explain the invention and are not intended to limit it.

The questions such as whether the strength of the plastic tableware is enough, whether the weight of the plastic tableware can be reduced, whether the plastic tableware is easy to be broken, and whether the plastic tableware can be stably stacked with each other, are mainly reflected in the structure of tableware handle. Among all kinds of plastic tableware on the market, the cross-sectional structures of the tableware handles which have been disclosed are generally divided as following four types.

1. The cross section of the tableware handle has a transverse line shape (—). As the tableware handle has a sheet shape, it has a poor bending strength in the vertical direction of the handle surface of the tableware, and is easy to be bent. Accordingly, such defects should be overcome by increasing the thickness or adding reinforcing edges which are perpendicular to the handle surface and slightly protruding upward or downward at the left and right ends of the tableware handle. Although the thickness is increased or reinforcing edges are added, such structures are still easy to be broken, and cannot be stably stacked with each other. That is because there are no baffles at both sides of the tableware handle, which makes such tableware handle easy to slide left and right and cannot be stably stacked, not to mention being stacked high. Accordingly, such tableware handle is inconvenient to take out and place in, as well as package. In additional, as such tableware handle has a thick thickness, it is impossible to save the stacking space. Accordingly, such structure of the tableware handle is generally used in the heavy tableware.

2. The cross section of the tableware handle has an arch bridge shape (∩), which is characterized by that the cross-section of the handle surface has a trigonometric line shape (A) or an arc shape, however both sides of the cross-section have different angles relative to the handle surface, which results in following two different effects. The left and right sides of the tableware handle are perpendicular to the handle surface, while the heights of the sides are larger than the width of the handle surface for at least about 50%, and larger than the height of the tableware handle of the transverse line shape. Accordingly, such kind of tableware handle has a better strength and bending resistance than that of the tableware handle of the transverse line shape. However, if the wall thickness of the tableware handle is not large enough, its strength and bending resistance are still insufficient, and it is still easy to be broken or tore off. In order to improve the strength and bending resistance, it is necessary to increase the thickness of the handle wall of the tableware, or add X-shaped reinforcing ribs at the back surface of the tableware handle, which would increase the weight of the tableware handle. Meanwhile, the strength difference between the reinforcing rib position and the surrounding points around the reinforcing rib position would be greater, resulting that the surrounding points around the reinforcing rib position will be easier to be broken, and the impact force generated at the breaking is stronger and results in greater danger. In additional, such structure has the same defect as that of the transverse line shape, that is, both of which cannot be stacked high.

3. Both sides of the tableware handle are bent to form an obtuse angle with respect to the handle surface of the tableware handle, while the heights of the sides are close to the width of the handle surface. If the obtuse angle is large enough, the tableware handle can be stacked high. The larger the obtuse angle, the better the stacking performance; while the poor the strength and bending resistance of the tableware handle. In additional, if the handle wall of the tableware handle is thin, the tableware handle would have worse strength and bending resistance. Accordingly, in order to improve the strength, the wall thickness of the tableware handle should be increased or X-shaped reinforcing ribs should be added at the back surface of the tableware handle. Similarly, problems of weight increasing or easy to being broken will also occur. However, as the wall thickness of the handle is increased for strengthening strength, or X-shaped reinforcing ribs are added to the back surface of the tableware handle, the handle thickness should be correspondingly increased which makes the space saved by stacking not obvious.

4. The cross section of the handle surface of the tableware handle has a simple trigonometric line shape (∧) or an inverted trigonometric line shape (∨). Both sides are located at both sides of the central axis of the tableware handle and form an angle of less than 180 degrees. Such kind of tableware handle can be stacked high stably. However, if the handle wall of the tableware handle is thin, the tableware handle would have worse strength and bending resistance. Accordingly, in order to improve the strength, the wall thickness of the tableware handle should be increased or X-shaped reinforcing ribs should be added at the back surface of the tableware handle. Similarly, problems of weight increasing or easy to being broken will also occur.

To sum up, the disposable plastic tableware should not only conform to the stacking structure, but also require to reduce weight and have enough strength, especially not easy to be broken. These are contradictory aspects, but also the problems which should be solved urgently in the current development of disposable plastic tableware which can be stacked.

FIGS. 1-12 have shown a preferable embodiment of the present application. The tableware handle 14 comprises a handle body 141 with a central axis A, wherein the handle body 141 has a cross section of "W" shape which is axisymmetrically distributed along the central axis A. The following components are further detailed below.

As shown in FIG. 1, the present embodiment has provided a fork 31 comprising a tableware handle 14 and a food taking portion 12 arranged at one end of the tableware handle 14. The food taking portion 12 and the tableware handle 14 are fixedly connected. Preferably, the food taking portion 12 and the tableware handle 14 are formed in one piece.

Figure 2:
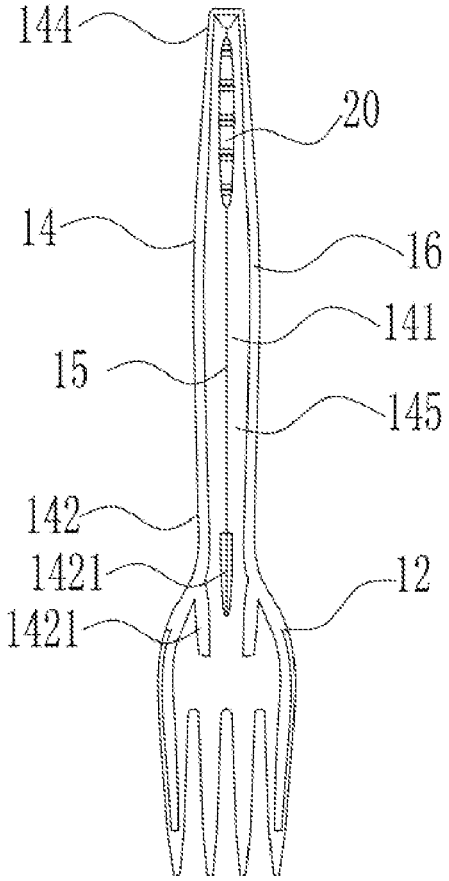
FIG. 2 is a structure diagram of a front surface of the fork according to a preferable embodiment of the present application.
Figure 3:
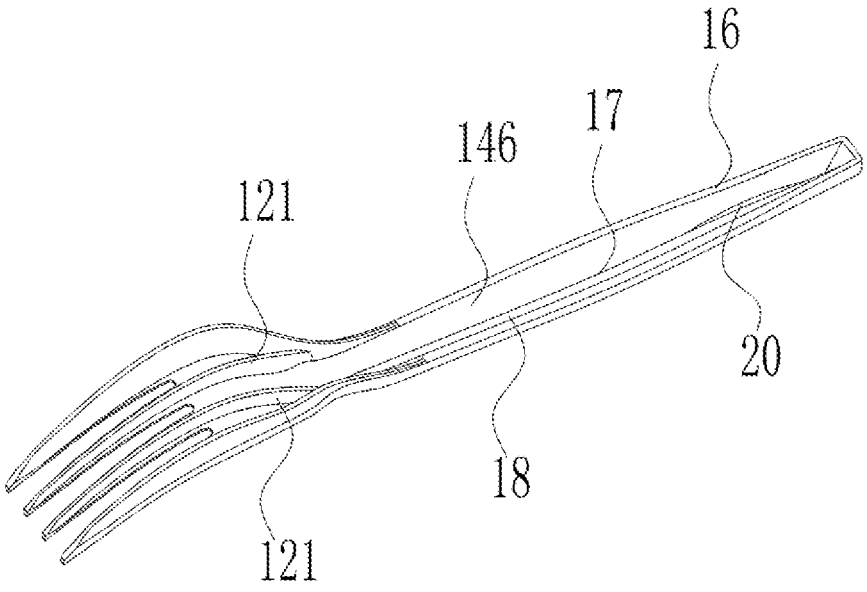
FIG. 3 is a stereogram of a fork from another angle according to a preferable embodiment of the present application.
Figure 4:
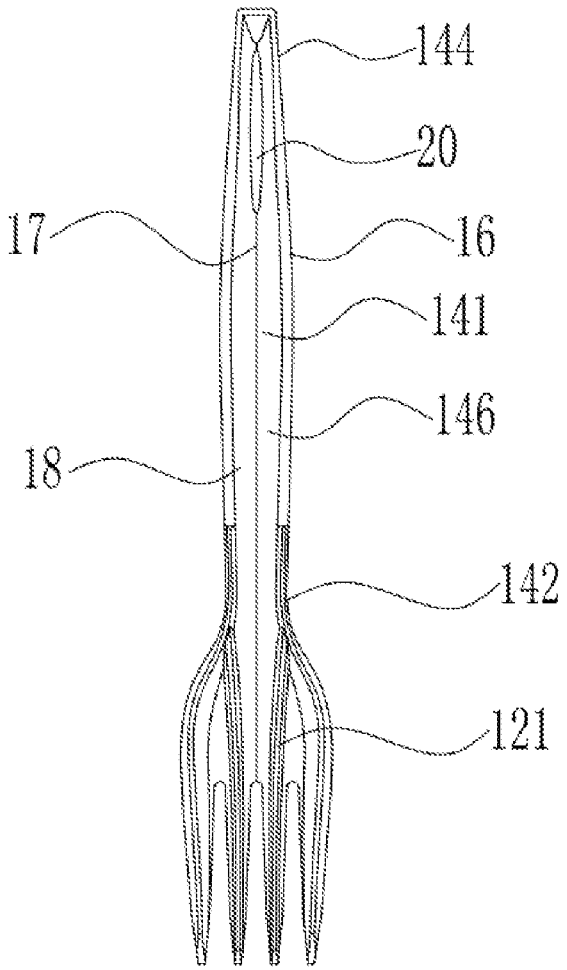
FIG. 4 is a structure diagram of a back surface of the fork according to a preferable embodiment of the present application.

As shown in FIGS. 1-4, the tableware handle 14 comprises a handle body 141, a neck portion 142, a tail portion 144, a front surface 145 and a back surface 146. The neck portion 142 is arranged at one end of the handle body 141 which is close to the food taking portion 12 and connected with the food taking portion 12. The tail portion 144 is arranged on the other end of the handle body 141 which is far away from the food taking portion 12. As shown in FIGS. 1-2, the front surface 145 is upward during using, while as shown in FIGS. 3-4 the back surface 146 is downward during using.

In order to facilitate the user to take the fork 31, a positioning concave structure 20 having a crescent shape is arranged at an end of the front surface 145 of the handle body 141. The positioning concave structure 20 is provided with anti-skid lines on its surface. The positioning concave structure 20 extends from the end of the handle body 141 to be cross-linked with the tail portion 144. The positioning concave structure 20 has a function for facilitating the thumb grabbing and preventing the fork 31 from sliding down when the fork 31 is taken from the self-service device for taking tableware.

In order to enhance structural strength, the fork 31 further comprises an enhancing block 1421 and a fork tooth reinforcing strip 121. The enhancing block 1421 is arranged at the connection and transition portion between the tableware handle 14 and the food taking portion 12 for improving the strength of the connection and transition portion between the tableware handle 14 and the food taking portion 12. The fork tooth reinforcing strip 121 is arranged at the back surface of the fork 31 and extends from the neck portion 142 of the tableware handle 14 and the end of the fork tooth.

Figure 6:
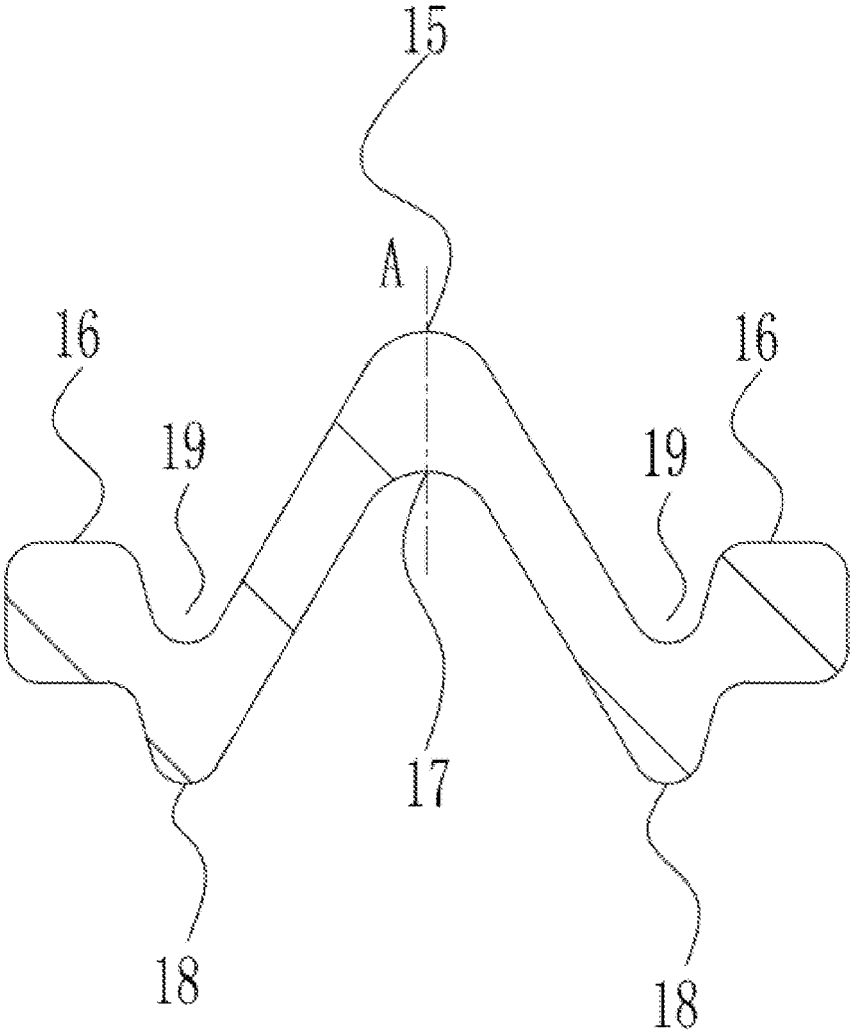
FIG. 6 is a sectional view of the B-B face of FIG. 5.

As shown in FIG. 6, the tableware handle 14 is arranged with a central axis A and has a cross section of "W" shape (or "M" shape) which is axisymmetrically distributed along the central axis A. The tableware handle 14 comprises the handle body 141 and two reinforcing strips 16 which are respectively arranged at both side edges of the handle body 141.

As shown in FIGS. 1-4, there are two reinforcing strips 16 respectively arranged at both side edges of the handle body 141. To be specific, there are two reinforcing strips 16 extending from side edges of the tail portion 144 to the both side edges of the middle portion of the food taking portion 12. As the reinforcing strips 16 are strong enough, it can share some of the external force on the handle body 141, and especially can prevent the deformation and displacement of both side edges of the handle body 141 towards the left side and the right side when the external force is applied on the both side edges of the handle body 141, and reduce the bending deformation of the handle body 141. When in use, the tableware handle 14 is held in the hand and the tableware handle 14 is strong and comfortable to use.

Figure 5:
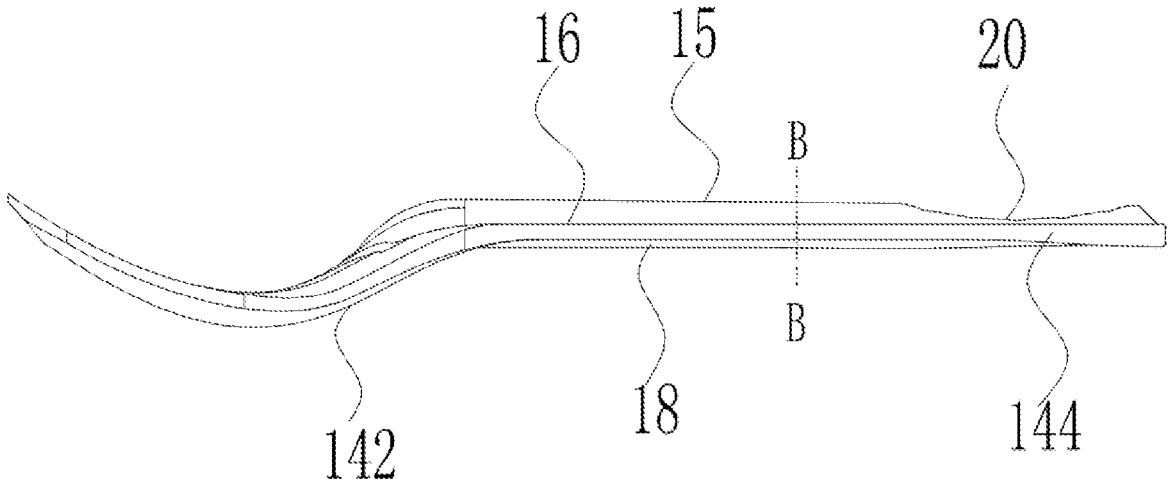
FIG. 5 is a side view of a fork according to a preferable embodiment of the present application.

As shown in FIGS. 5-6, the handle body 141 is a triangular body with an unclosed bottom surface, and which structure has a stronger strength with considerable bending and twisting resistance when comparing with the handle body 141 of other types. Specifically, the handle body 141 comprises a convex 15 and a concave groove 17 extending along the central axis A, and a reinforcing rib 18 and a reinforcing rib groove 19 symmetrically arranged on both sides of the convex 15 and the concave groove 17.

Specifically, the reinforcing rib 18 is arranged on the back surface of the handle body 141, the reinforcing rib groove 19 is arranged on the front surface 145 of the tableware handle 14. The reinforcing rib 18 and the reinforcing rib groove 19 have adapted position and size, such that the reinforcing rib 18 of one fork 31 can be exactly placed in the reinforcing rib groove 19 of the other fork 31. The cross section of the reinforcing rib 18 is triangular, and is connected with the reinforcing strip 16. Please referring FIGS. 1 and 3, along the length direction of the tableware handle 14, both of the reinforcing rib 18 and the reinforcing rib groove 19 are extending all through from the tail portion 144 to the neck portion 142, and in parallel to the reinforcing strip 16. Through the reinforcing rib 18, when the food taking portion 12 is stressed during the food taking process, the whole fork 31 are not easy to be bent to deform, which can ensure the normal use of fork 31.

At the same time, the reinforcing rib 18 has strengthens the structure strength of convex 15 and concave groove 17, so that the stiffness of the tableware handle 14 can be increased and the material can be saved without adding any other superfluous materials. As shown in FIG. 6, the convex 15 and the concave groove 17 make the tableware handle 14 to appear a trigonometric line shape (A). The convex 15 having a triangular cross section is arranged on the front face 145 of the tableware handle 14, and extends from the central axis A to the outer side edges far away from the central axis A until the convex 15 connects the reinforcing rib 18, that is, the convex 15 extends from the reinforcing rib 18 at one side to the reinforcing rib 18 at the other side.

In the length direction of the tableware handle 14, the convex 15 and the concave groove 17 both extend all through from the tail portion 144 to the neck portion 142. The convex 15 and the concave groove 17 have adapted position and size, such that the convex 15 of one fork 31 can be exactly accommodated in the concave groove 17 of the other fork 31.

Compared with the traditional fork, the advantages of the present embodiment are that the tableware handle 14 has a "W" shape handle structure which is formed by connecting three sharp corners of two reinforcing ribs 18 and one convex 15. The anti-deformation reinforcing handle formed by two reinforcing ribs 18 and one convex 15 has a comfortable handling feeling during the use and is not easy to be bent and deformed when used. Especially in injection molding process, it saves raw materials and reduces manufacturing cost. Moreover, the tableware handle 14 of the present application has the functions of safe, light, comfortable and environmental protection.

Figure 7:
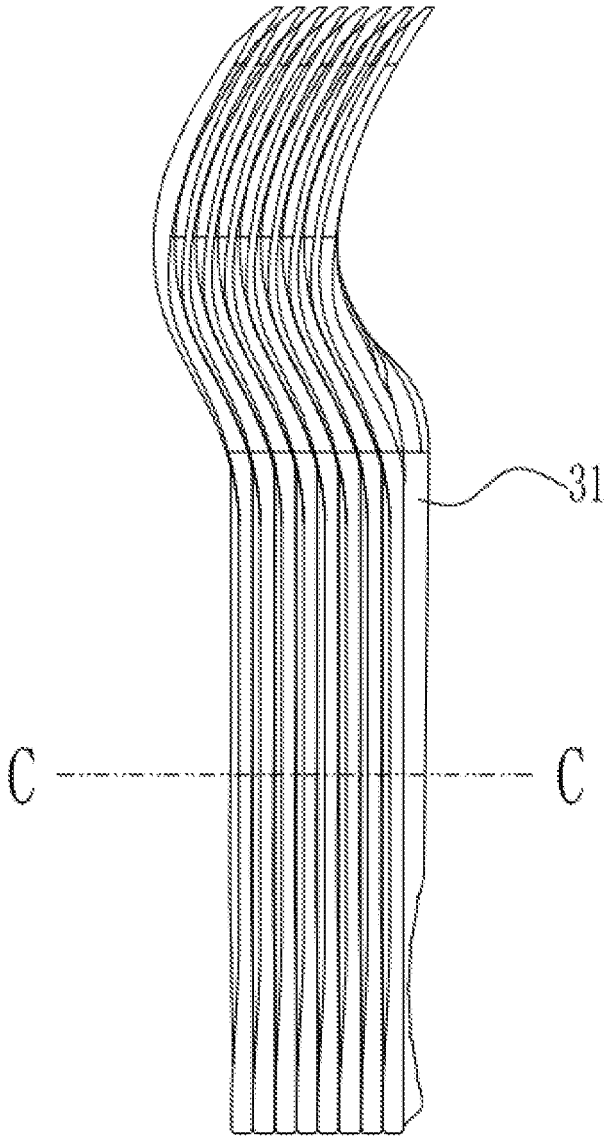
FIG. 7 is a side view of a plurality of forks tightly embedded and stacked together in a preferred embodiment of the present application.
Figure 8:
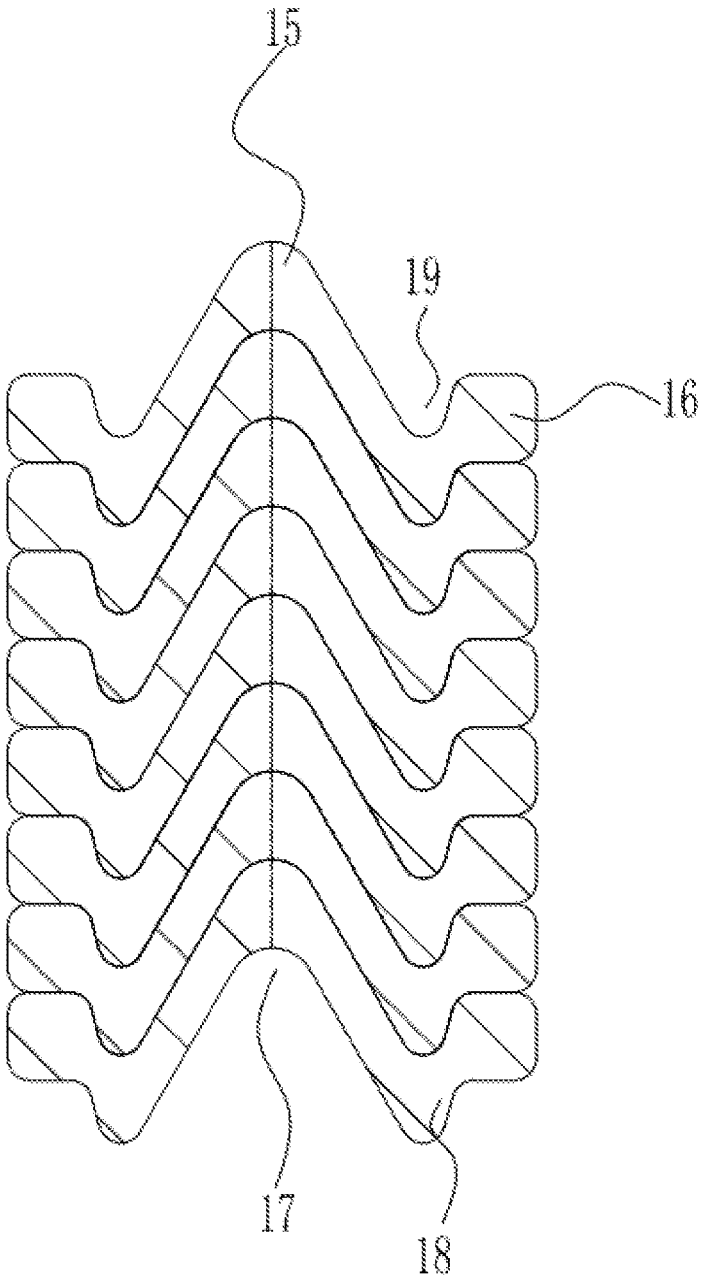
FIG. 8 is a sectional view of the C-C face of FIG. 7.

As shown in FIGS. 7 and 8, when a plurality of tableware handle 14 are tightly embedded and stacked together, the reinforcing strip 16 of one fork 31 is placed on the reinforcing strip 16 of the adjacent fork 31, and the reinforcing rib 18 of the fork 31 is exactly accommodated in the reinforcing rib groove 19 of the adjacent fork 31, and the concave groove 17 of the fork 31 is placed on the convex 15 of the adjacent fork 31, which minimizes the stacking clearance between the tableware handles 14. In the present embodiment, the structure of the tableware handle 14 is the one which is most easily to increase the stacking height and save storage space. Because of this stackable design structure, when a group of forks 31 are stacked together, there should be a relatively low packing height, which effectively utilizes the packaging space.

Preferably, the fork 31 of the present application is made of PP plastic (polypropylene plastic). In the present embodiment, the food taking portion 12 and the tableware handle 14 of the fork 31 are all made of PP plastic by one injection molding. When used improperly, or when the tableware handle 14 is forced to bend destructively, the tableware handle 14 is not easy to break apart. The PP plastic is also known as a rubber which can be twisted for multiple times, which is easy to be broken at the gap presented on the surface. However, if some portions of the PP plastic are bent by an excessive force but not broken off, the long molecular chain of the PP plastic at these portions would be reoriented to form a structure which is harder to be broken off, and then the portion of the PP plastic would be difficult to be broken off.

As no "X" shape reinforcing grid is needed for the tableware handle 14 of the fork 31, the tableware handle 14 has uniform strength at different segments but no special weak portions. Accordingly, when the destructive external force is applied, no breaking point would be easily to generate. No matter a destructive external force is applied along the direction which is perpendicular to the forward direction of the handle surface or the backward direction of the handle surface, such force would be applied first onto the convex 15, and then to the two reinforcing ribs 18 which push the reinforcing strips 16 to translate towards the left side and the right side respectively, and finally bend and deform the same. As mentioned above, in the bending and deformation process of the tableware handle 14, as no special weak point would form the breaking point, the tableware handle is unlikely to be broken and no breaking apart situation of the tableware handle would be produced, let alone the fragments.

In the present application, the cross-sectional area of the handle body 141 accounts for more than 70% of the cross-sectional area of the tableware handle 14, so if the thickness of the handle body 141 is reduced, the weight of the tableware handle 14 can be effectively reduced. As mentioned above, the fork structure of the present application can reduce the thickness of the handle wall properly, while has little effect on the handle strength. Accordingly, the fork 31 of the present application can be made lighter.

The fork 31 of the present application has a lightweight and good strength, is especially not easy to be broken and can be stacked stably. Moreover, there are small stacking clearance between the forks 31, saving packaging, storage and transportation space. In additional, the fork 31 is safe to use, light, comfortable and environmental protected. Furthermore, the fork 31 can be stably stacked with each other, so is particularly suitable for being positioned the blanking system of the automatic fork packaging machine, thus improving the automatic packaging efficiency of tableware.

Figure 9:
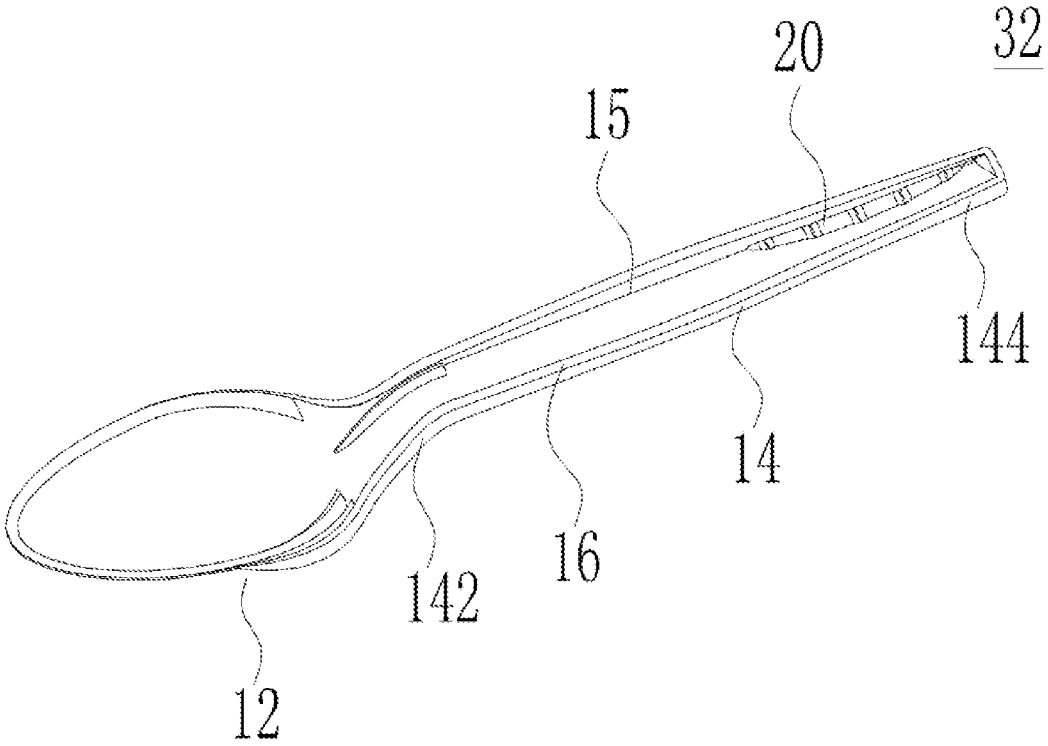
FIG. 9 is a stereogram of a spoon from an angle according to a preferable embodiment of the present application.
Figure 10:
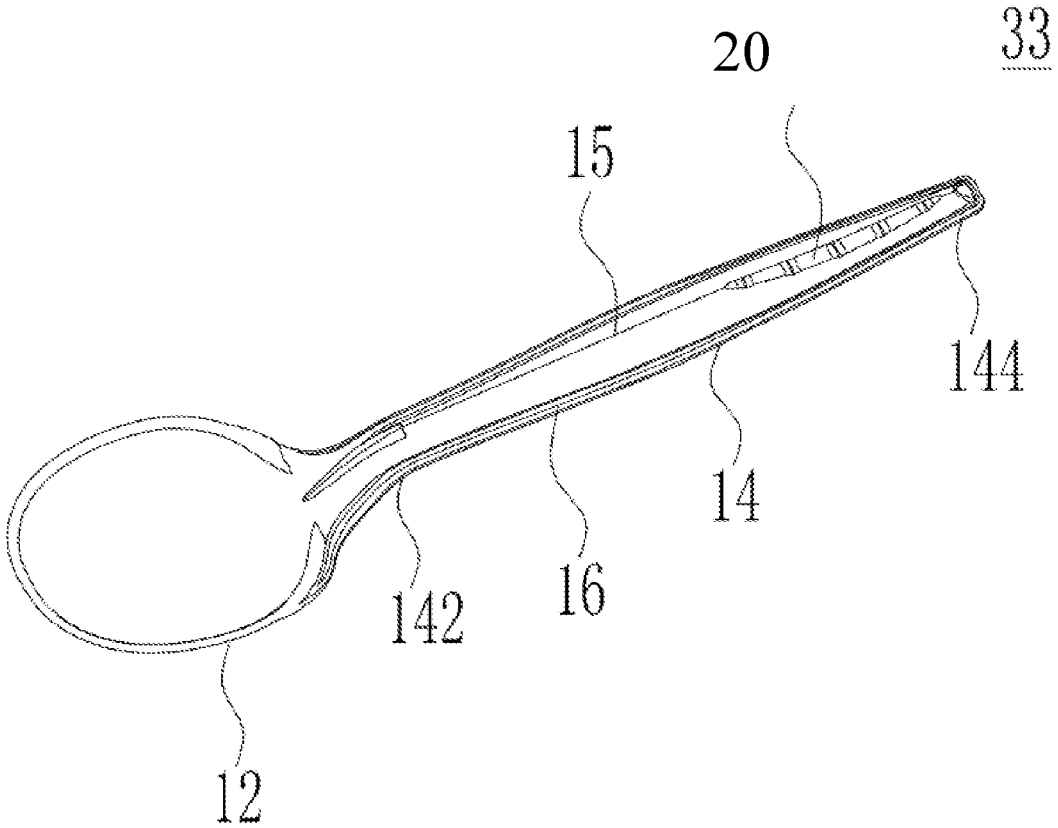
FIG. 10 is a stereogram of a soup ladle from an angle according to a preferable embodiment of the present application.
Figure 11:
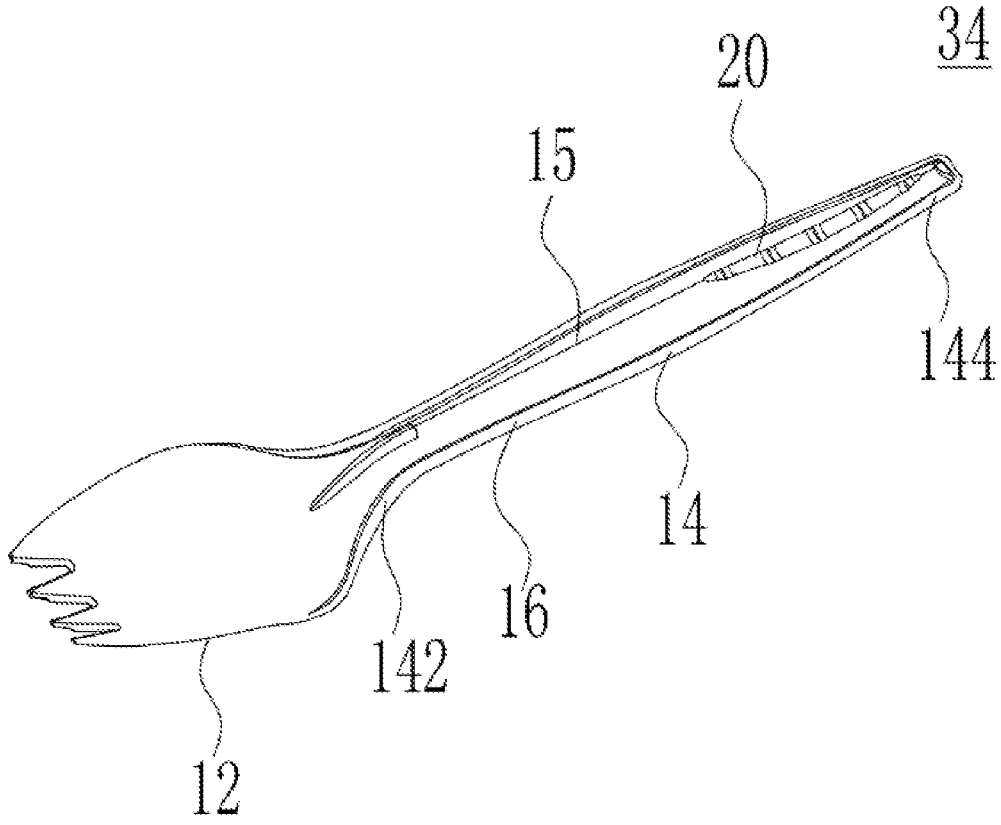
FIG. 11 is a stereogram of a fork spoon from an angle according to a preferable embodiment of the present application.
Figure 12:
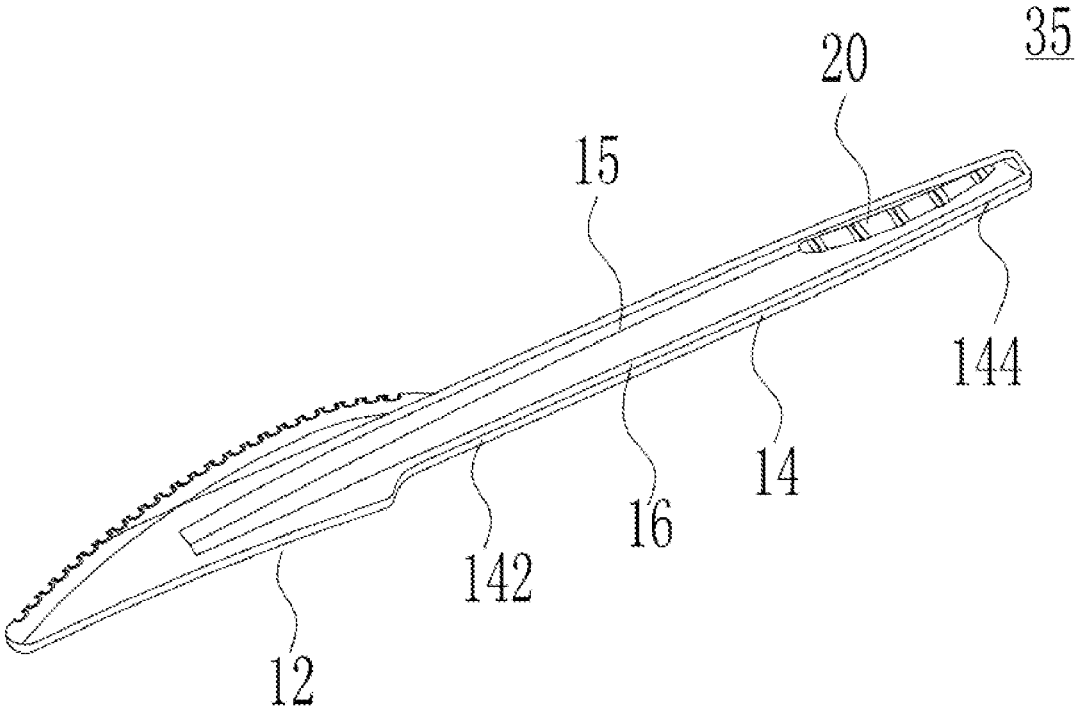
FIG. 12 is a stereogram of a table-knife from an angle according to a preferable embodiment of the present application.

It is understandable that the present embodiment describes the structure of the tableware handle 14 with the fork 31 as an example, however the tableware handle 14 of the present application is not limited to the fork 31, but can also be used in tableware such as spoon 32 (as shown in FIG. 9), soup ladle 33 (as shown in FIG. 10), fork spoon 34 (as shown in FIG. 11) and table knife 35 (as shown in FIG. 12).

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

What is claimed is:

1. A tableware handle comprising a handle body (141), a neck portion (142) arranged at a first end of the handle body (141) and a tail portion (144) arranged at a second end of the handle body (141), the handle body (141) has a "W" shape cross section formed by a convex (15), two reinforcing grooves (19) and two reinforcing ribs (18) symmetrically arranged on both sides of the convex (15), the convex (15) has a trigonometric line shape, the convex (15) is extending along a length direction of the handle body (141) at a center of the handle body (141);

wherein a positioning concave structure (20) having a crescent shaped surface is arranged on a front surface (145) of the handle body (141); wherein the surface of the positioning concave structure (20) extends along the length direction of the handle body (141) on the tail portion (144), the surface of the positioning concave structure (20) is provided with anti-ski lines;

the handle body (141) has the front surface (145) and a back surface (146), in which the front surface (145) containing a culmination of the convex (15) and a culmination of the reinforcing grooves (19) and the back surface (146) containing a back surface of the convex (15) which forms a concave groove (17) and a bottom surface of the two reinforcing ribs (18); wherein the convex (15) and the concave groove (17) both extend along from the tail portion (144) to the neck portion (142); the two reinforcing grooves (19) and the two reinforcing ribs (18) are all extend along the tail portion (144) to the neck portion (142).

2. A tableware comprising a tableware handle and a food taking portion fixedly connected with each other; wherein the tableware handle comprises a handle body (141), a neck portion (142) arranged at a first end of the handle body (141) and a tail portion (144) arranged at a second end of the handle body (141), wherein the neck portion is connected to the food taking portion; the handle body (141) has a "W" shape cross section formed by a convex (15), two reinforcing grooves (19) and two reinforcing ribs (18) symmetrically arranged on both sides of the convex (15), the convex (15)

has a trigonometric line shape, the convex (15) is extending along a length direction of the handle body (141) at a center of the handle body (141);

wherein a positioning concave structure (20) having a crescent shaped surface is arranged on a front surface (145) of the handle body (141); wherein the surface of the positioning concave structure (20) extends along the length direction of the handle body (141) on the tail portion (144), the surface of the positioning concave structure (20) is provided with anti-ski lines;

the handle body (141) has the front surface (145) and a back surface (146), in which the front surface (145) containing a culmination of the convex (15) and a culmination of the reinforcing grooves (19) and the back surface (146) containing a back surface of the convex (15) which forms a concave groove (17) and a bottom surface of the two reinforcing ribs (18); wherein the convex (15) and the concave groove (17) both extend along from the tail portion (144) to the neck portion (142); the two reinforcing grooves (19) and the two reinforcing ribs (18) are all extend along the tail portion (144) to the neck portion (142).

* * * * *